United States Patent [19]

Graham

[11] Patent Number: 4,706,953

[45] Date of Patent: Nov. 17, 1987

[54] ACTIVE/PASSIVE EXERCISE APPARATUS

[76] Inventor: Gary A. Graham, P.O. Box 2000, Glacier, Wash. 98244

[21] Appl. No.: 1,192

[22] Filed: Jan. 7, 1987

Related U.S. Application Data

[63] Continuation-in-part of Ser. No. 786,540, Oct. 11, 1985, abandoned, which is a continuation-in-part of Ser. No. 696,254, Jan. 29, 1985, abandoned.

[51] Int. Cl.[4] ..... A63B 21/02

[52] U.S. Cl. ..... 272/120; 272/72; 272/127; 272/128; 272/134

[58] Field of Search ..... 272/72, 120, 121, 134, 272/144, 127, 128, 142, 136; 128/25 R

[56] References Cited

U.S. PATENT DOCUMENTS

| | | | |
|---|---|---|---|
| 1,247,869 | 11/1917 | Ostlin | 272/72 |
| 1,996,350 | 4/1935 | Schaff | 272/120 |
| 3,622,154 | 11/1971 | Williams | 272/134 X |
| 3,770,267 | 11/1973 | McCarthy | 272/72 X |
| 4,101,124 | 7/1978 | Mahnke | 272/144 X |
| 4,198,045 | 4/1980 | Miller | 272/142 |
| 4,272,074 | 6/1981 | Sefrle | 272/120 |

FOREIGN PATENT DOCUMENTS

| | | | |
|---|---|---|---|
| 667083 | 9/1964 | Italy | 272/72 |
| 469155 | 12/1928 | United Kingdom | 272/72 |
| 2407907 | 8/1975 | United Kingdom | 272/134 X |

*Primary Examiner*—Richard J. Apley
*Assistant Examiner*—J. Welsh
*Attorney, Agent, or Firm*—Robert W. Jenny

[57] ABSTRACT

In the subject apparatus, the user lies back down on a platform which is roller mounted on parallel tracks and movable from end to end of the tracks. The platform is biased toward a position essentially midway between the ends by primary and secondary energy storage and release apparatuses. The secondary apparatus is engaged by the platform after it has moved partway toward one end or the other. Both apparatuses are adjustable in terms of spring rates and storage capacities. The engagement points of the platform with the secondary apparatus are adjustable. Hand grips are attached to the track assembly by cables and are used by the user for setting the platform into oscillating motion on the track. A footrest is also attached to the track assembly so that the user can set the platform into motion by applying foot pressure with either or both feet in combination, if desired, with force exerted by either or both hands. The acceleration forces achievable are in excess of the force of gravity and the platform is equipped with supports and stops for stabilizing the position of the user on the platform. The exercise provides cardiovascular stimulation, passive exercise of all components of the body and the active exercise of setting the platform in motion and maintaining the motion.

3 Claims, 4 Drawing Figures

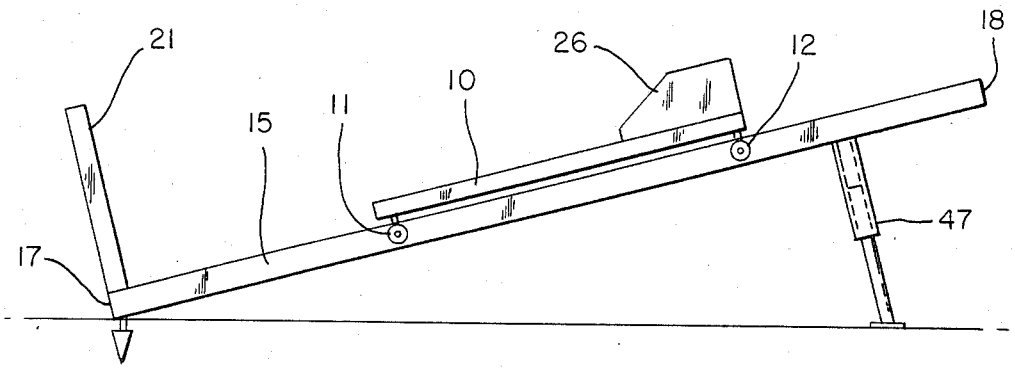
FIG. 3
FIG. 4
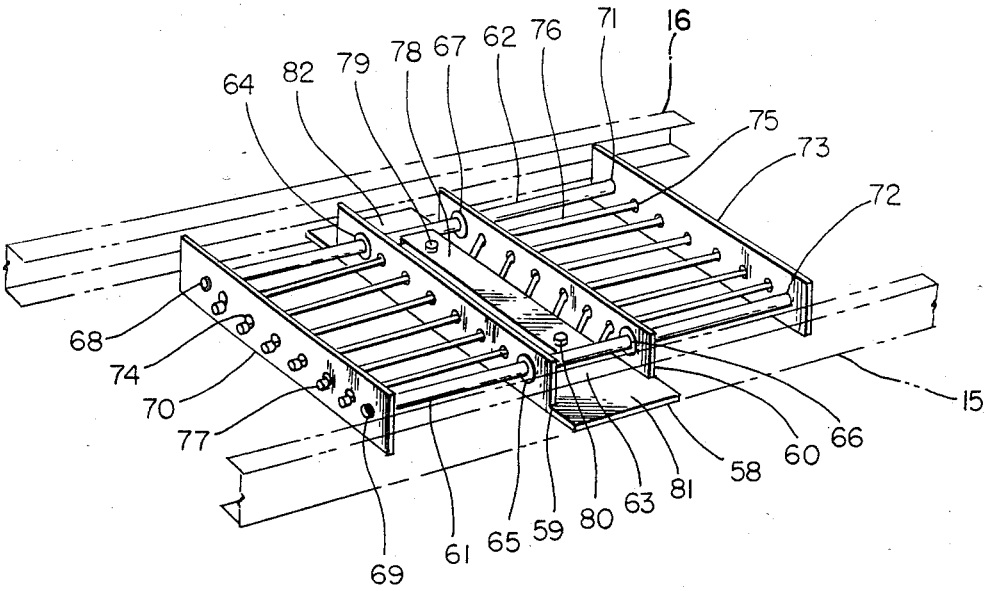

ACTIVE/PASSIVE EXERCISE APPARATUS

BACKGROUND OF THE INVENTION

This application is a continuation-in-part of application Ser. No. 786,540, filed 10/11/85, now abandoned which is a continuation-in-part of application Ser. No. 696,254, filed 1/29/85, now abandoned.

FIELD OF THE INVENTION

The subject invention is in the field of exercise apparatus. More specifically it is in the field of such apparatus for exercising internal organs and skeletal muscle groups along with exercise of virtually all voluntarily controlled muscles. Still more particularly, the apparatus is in the field of art related to exercise ranging from totally passive in which the person exercising makes no energy input to highly active in which the exercising person provides all the input energy at whatever level is judged to be appropriate. Further, the invention is in the field of such apparatus which accommodates the user in a supine position.

PRIOR ART

Prior art in this field is profuse, ranging from cradles, swings, rocking chairs, rocking horses, pogo sticks, trampolines and the like, to the rocking tables used in hospitals and other care centers for exercising invalids and the apparatus designed to provide exercise for people in zero gravity environment space travel.

The inventor was involved in the design, development and testing of space-oriented exercise apparatus with The Boeing Company, Aerospace Division in 1963. (Aerospace Medicine, Dec. 1966 "Independence of Changes in Functional and Performance Capacities Attending Prolonged Bed Rest.") The related art found in a preliminary search of the art is listed here:

U.S. Pat. Nos.:
4,198,045 Miller
4,149,713 McLeod
3,770,267 McCarthy
3,586,322 Kverneland
3,164,150 Reid
2,841,139 Tarr
1,750,549 Thomson et al.

Further art, found by the Examiner in relation to processing the parent application to the subject application, included a German Pat. No. 469,155 by Raihofer and U.S. Pat. No. 4,101,124 by Mahnke. All the examples in the prior art provide passive and/or active exercise of various types and degrees with various means and techniques for adjusting and/or controlling the various characteristics of the exercises. All the various kinds and types of apparatus and equipment can be compared in terms of cost, space requirements, effectiveness, versatility, serviceability, utility and other factors, including environmental effects such as noise.

In spite of the profuseness of the prior art, apparatus providing certain attributes, either generally desirable or desirable under certain circumstances, has not been found and is not known to be available. The attributes can be desired singly and in combinations.

One attribute is that the apparatus offers essentially equivalent effects in both the foot-to-head and head-to-foot directions. Another attribute is that the person exercising or being exercised be subjected to forces parallel to the spinal column with the forces ranging from less than the person's weight to more than the person's weight or, in more technical terminology, less than the force of gravity to more than the force of gravity, usually expessed in terms of g, the acceleration of gravity: less than 1 g to more than 1 g. This attribute is enhanced when the magnitudes of the forces in the foot-to-head direction can be independently controllable relative to the magnitudes of the forces in the head-to-foot direction.

Further, this attribute is enhanced when it can be achieved without subjecting the person's feet and legs to the loads and efforts needed to achieve it and still further enhanced if the degree to which the feet and legs are involved may be controlled.

Another attribute is that the exercise is primarily for the purpose of relaxation, cardiovascular stimulation and toning as different from exercise primarily for developing strength.

From the preliminary search for the subject invention and the subsequent citations of prior art by the Examiner in the presention of the original application and the first C.I.P. application, further prior art has been accumulated. These patents include:

U.S. Pat. Nos.: 1,247,869 and 3,622,154
German Pat. No.: 469,155
Italian Pat. No.: 667,083

In the apparatus in some of the prior art patents the user is or may be prone, such U.S. Pat. Nos. as 2,841,139; 3,164,150; 4,101,124; 4,198,045, 4,272,074, and German Pat. No. 469,155. Also, some of these various patented concepts offer the attribute of essentially equivalent effects in both the foot-to-head and head-to-foot directions. Several of the concepts offer the attribute of exercise with feet and legs variable or optional. Further, some offer the specific attributes of controlled forces ranging from less than the force of gravity to more than the force of gravity and having the magnitudes of head-to-foot direction forces be independently controllable related to the magnitudes of foot-to-head direction forces. In particular, U.S. Pat. No. 1,247,869 shows the use of dual energy storage and release apparatus, the secondary apparatus being coil springs. None appear to provide exercise primarily for the purpose of cardiovascular stimulation and toning as different from exercise primarily for developing muscle strength. Further, none show apparatus combining two energy storage and release systems with both adjustable in terms of capacity (force levels or force level and stroke lengths).

Therefore, it is an objective of the subject invention to provide exercise apparatus in which the person exercising or being exercised is subjected to forces in directions essentially parallel to the backbone and from head toward foot and foot toward head with the magnitudes of the forces controllable in the range from a fraction of the force of gravity to multiples of the force of gravity. Another objective is that the forces have a dual rate of variation characteristic, adjustable to suit the requirements of the user. A still further objective is that the magnitude of the forces in the direction from foot to head to be independently controllable relative to the magnitude of the forces in the direction from head to foot. This objective can be termed adjustable differentiation between the forces in each direction. And a further objective is that the apparatus enable providing exercise primarily for the purposes of cardiovascular stimulation and toning. Still further objectives are that the apparatus be simple to use and that it be compact in terms of space required for use and for storage. Still other objectives will be apparent in the following descriptions and discussion of the invention.

SUMMARY OF THE INVENTION

The present invention is an exercise apparatus comprising basically a platform accommodating the user and moveable back and forth along a track with means biasing the platform to a position of rest intermediate of the limits of the motion. The track is essentially horizontal and rectilinear but can be sloped and/or arced so that portions of the track are higher than others from the floor or other support on which the apparatus is used. The user lies supine on the platform. Using appropriate supports, guides, restraints, etc., the user and platform are put into reciprocating motion on the track. The energy for the motion is provided by a power source or the person or by some combination. In reciprocating motion, the masses of the person and platform are accelerated in one direction, stopped and accelerated in the other direction, head to foot, to be decelerated, stopped and again accelerated in the first direction with the cycle repeating as many times as needed or desired. As is well known, the accelerations and decelerations (or positive and negative accelerations) produce inertial forces on the person's body and all of its parts. When the acceleration rate is 32.2 feet per second squared (32.2 ft/sec$^2$), the inertial force is equal to the force of gravity and is equal to the person's weight. As these forces are applied the skeletal muscles, tissues, etc. of the person's body are called upon to perform their various functions in maintaining the shape, formation and integrity of the body and are thus exercised. In particular, the cardiovascular system is stimulated. In addition, if the energy for initiating and maintaining the motion is provided by the person, then those elements of the person's body used in causing and/or controlling the motion are also exercised.

The motions of the platform and person on it are influenced and limited by various energy storage and release means (springs, elastic cords, counterweights, track slopes, supplemental energy storage and release means, limiting means [limit stops] and the like). Energy storage and release means are incorporated to position the platform at some point intermediate to the extremes of its travel when the apparatus is at rest, i.e. bias the platform toward a position between the extremes of its travel. The characteristics of these means can be adjustable, such as adjustable spring rates of the elastic cords and/or the number of such cords in use at one time.

The supplemental energy storage and release apparatus termed, for convenience, supplemental converter means are an essential element of the subject invention. The converter means interacts between the moving platform and the track assembly on which it moves. In a preferred form, the converter means comprises elastic cords (bungee cords) incorporated into apparatus which effects engagement of the apparatus with the platform as the platform moves toward the limits of its excursions and functions to supplement the effects of the means which bias the platform toward a position between the extremes of its travel. It has been found that adjustability of the converter means as well as the biasing means contributes significantly to the effectiveness of the invention. The supplementation takes the form of an increase in the rate of change of the biasing forces. The increases produce changes in acceleration forces known as acceleration spikes. To achieve the objective of acceleration forces on the user in the range near to and above the force of gravity without the spikes would require reciprocal cycling of the platform at undesirable and possibly unsafe rates. With the spikes, the desired acceleration forces can be achieved in a modest range of reciprocal cycling rates. Also, it is important that the converters be efficient and absorb very little energy since such absorption tends to defeat their purpose. Since the acceleration of the person on the machine exceeds 1 g., it is necessary to have a tie down point on the base of the machine to keep it from moving.

As can be recognized by those familiar with the art, the variety of patterns of motions and forces achievable on such apparatus is great, within limits. The simplest is considered to be simple harmonic motion of the platform oriented centrally to the length of track with any chosen stroke length within the physical limits of the machine. At the opposite end of the spectrum of motion patterns, the person and platform would be rapidly accelerated at one end of the stroke, travel at essentially constant velocity to near the other end of the stroke and there be rapidly decelerated, stopped and re-accelerated in the other direction.

The apparatus is similar to a trampoline but has extending features in that active participation of the legs in the exercise can range from zero to multiples of the force of gravity, the forces in the head to foot and foot to head directions can range from less than the force of gravity to more than the force of gravity and the force levels are adjustable and/or controllable.

Obviously, apparatus having these characteristics can be implemented in many ways. The basic principles are simple, the benefits have been demonstrated and yet there has been no known equipment which meets the objectives outlined above.

BRIEF DESCRIPTION OF THE DRAWINGS

FIG. 3 is an elevation view of t he apparatus raised at one end to introduce differentiation between the forces in foot-to-head and head-to-foot directions.

FIG. 4 is a schematic, perspective drawing of the secondary energy storage and release apparatus.

DETAILED DESCRIPTION OF THE INVENTION

The subject invention is described in detail with reference to the preferred embodiment depicted in FIG. 1, supplemented by equipment for powering it depicted in FIG. 2.

Figure 1:
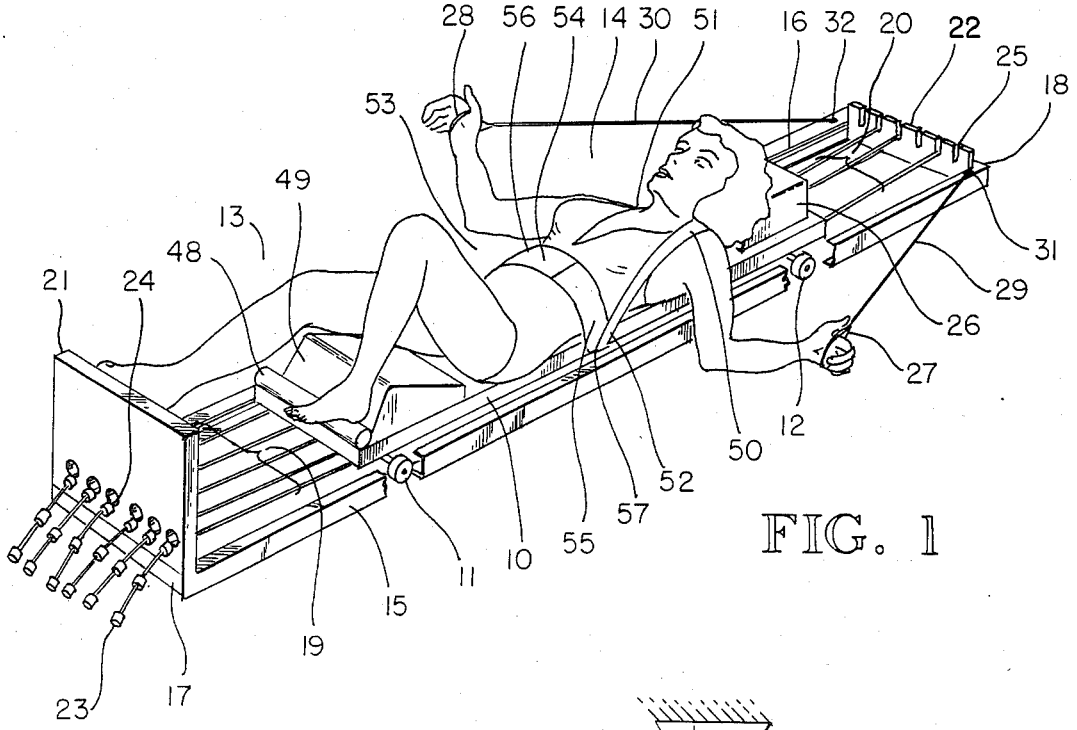
FIG. 1 is a semi-schematic perspective view of a preferred embodiment of the subject invention.
Figure 2:
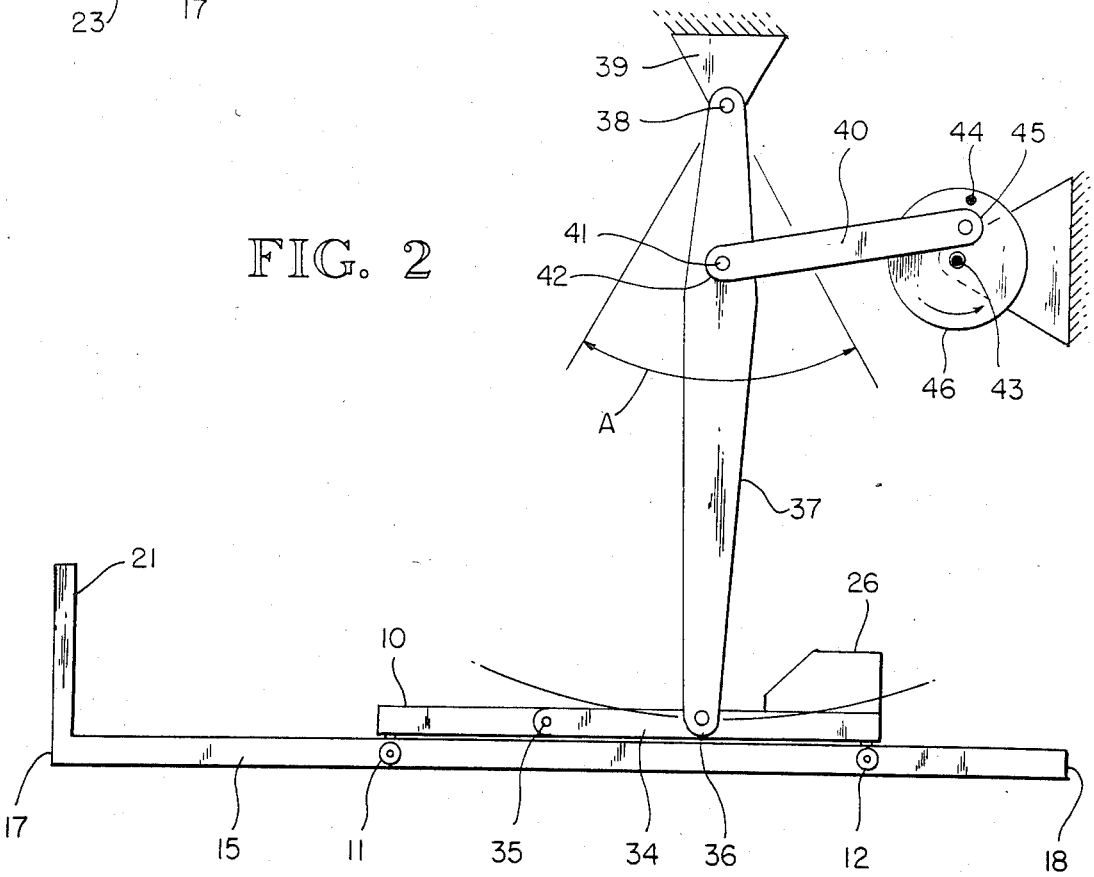
FIG. 2 is a schematic diagram of means for powering the apparatus of FIG. 1.

Referring to FIG. 1, in this embodiment the apparatus comprises a user accommodating platform 10 supported on the tracks by rollers 11, 12, 13 and 14 (13 and 14 not visible) engaged in the tracks 15 and 16. The tracks are attached to each other at their ends by members 17 and 18 to form a track assembly. The platform 10 is urged toward a position between the ends of the tracks to a position of rest by pluralities of bungee cords 19 and 20. The cords of plurality 19 are attached at one of their ends to member 21 attached to end 17 and at their other ends to points on the underside of platform 10. Each of the cords of plurality 20 is attached at one end to member 22 attached to end 18 and at its other end to a point on the underside of platform 10. The attachment points under the cradle are near its longitudinal point.

In a preferred embodiment there are six cords in plurality 19 and three in 20. However, each cord is attachable and put in use individually and the number used can be varied to suit requirements. Further, each cord can be installed with various initial tensions. The attachment is by means of ferrules attached to the cords, ferrule 23 being an example, the ferrules being engaged in slots in members 21 and 22 attached to ends 17 and 18. In member 17 the slots, of which slot 24 is typical, are part of keyhole shaped openings through which cords and ferrules are threaded to be attached for use. The multiplicity of ferrules on each cord enables setting various initial tensions into the cords. The slots in member 22, of which slot 25 is typical, are simple U shaped slots. This apparatus, as described, is a first and primary energy storage and release system in the apparatus. It is adjustable by virtue of the number of cords in use at each end and the initial tension set into each cord.

This energy storage release arrangement is shown in a relatively simple form. Within the scope of this invention, more sophisticated systems may be used, all within the design capabilities of those having ordinary skill in the art and providing for adjustments of the system. Such adjustments are useful in adapting the apparatus to match the exercise parameters needed or desired, including adaptation for the user's weight. The person using the apparatus, the user, lies back down on the platform with head supported by cushion 26, attached to platform 10. The platform is padded and may be contoured for added comfort and security of positioning of the user.

The exercising is initiated by setting the platform in motion from the position of rest to which it is urged by the primary energy storage and release apparatus and there are two means shown by which the motion can be caused. Motion can be caused by applying force against panel 21, attached upright from member 17, with one or both of user's feet. It can also be caused by the user gripping handles 27 and 28 in hands and pulling on lines 29 and 30 attached to the track assembly at points 31 and 32 respectively. In each case, the platform and user will achieve a velocity of motion in the direction of the user's head. Once the velocity is achieved, the force application is ceased and the velocity of the motion is decreased by the forces of the springs, the decreasing velocity being deceleration or negative acceleration. The acceleration, in combination with the mass of the user and all user's components, produces inertial forces on the user and all components. The forces applied for inputting the energy to cause the motion and the user's body resistance to the inertial force are the components of the exercise provided by the invention. The energy storage and release apparatus forces reduce the initial velocity to zero and then accelerate the platform and user to a velocity in the direction toward user's feet. The forces again accelerate the platform and user, reduce velocity to zero and then accelerate them in the direction of the original motion.

The energy storage and release apparatus can be replaced and supplemented by components of the force of gravity on the platform and user. This is achieved by making the tracks arcuate in elevation view, with the ends higher than the center. Gravitational forces will then tend to urge or assist in urging the platform toward the low point of the arcuate track.

If the apparatus were entirely free of friction, the motion, once initiated, would continue providing the forces which exercise the body and its components. However, there is friction and, to maintain the exercise, forces must be applied occasionally or cyclically by pushing with foot or feet and/or pulling on the handles. When the feet are not in use they may be positioned on the footrest 48 or held in mid-air. The physical strain of holding one foot or both feet in the air is reduced by cushion 49, which is positioned and shaped to support the user's thighs from the back. This cushion also serves to help limit the displacement of the user on the platform in the head-to-foot direction on the platform. Displacement of the user on the platform in the foot-to-head direction is limited by straps 50 and 51. (51 is not visible and is identical to 50 but of the opposite hand.) Straps 50 and 51 are stretchable and are attached to platform 10 at points just below the user's neck. They extend from the attachment points upward and over the shoulders and then along the sides of the user's body to detachable/attachable fasteners at points 52 and 53 (53 not shown). The user's body may also be held in place on platform 10 by the use of belt assembly 54. The assembly 54 comprises two sections, 55 and 56. Each of the sections is attached at one end to platform 10, such as at point 57 for section 55. The other ends of the sections overlap over the user's abdomen and are securable to each other by any suitable means such as Velcro (R).

In the event that the application of force produces greater displacement than can be overcome by the action of the primary energy storage and release apparatus, the motion of the platform and user is further biased a secondary energy storage and release apparatus.

The secondary apparatus, described below, functions to supplement the primary apparatus in urging the platform to a position between the two ends of the track assembly. It comes into effect when the platform reaches specific points in its excursions in each direction, as explained later. When the kinetic energy of the mass of the platform and user exceeds that which the primary apparatus can effectively handle, the secondary apparatus converts the excess kinetic energy to potential energy, storing energy until the velocity of the platform and user is zero. Then the secondary apparatus reconverts the potential energy back into kinetic energy supplied to the platform and user.

When the platform engages the secondary apparatus, the net force decelerating the total moving mass increases at a rate which is the sum of the net spring rate of the primary apparatus and the rate of the secondary apparatus. This increase in spring rate produces an increase in acceleration known as an acceleration spike at each end of the travel of the platform. It has been found that these spikes can be especially beneficial for cardiovascular stimulation of the user. If the energy in the system is such that the first and secondary apparatus cannot store it, the cradle is stopped by limit stops, described below.

The inclusion of the secondary energy storage and release apparatus is an essential feature of the subject invention. Having the secondary apparatus adjustable has been found to provide significant advantages in adapting the exercise apparatus to the needs of the user. Achieving the objective of acceleration forces on the user in the range near to and above the force of gravity without the spikes provided by the secondary apparatus would require reciprocal cycling of the platform at undesirable and possibly unsafe rates. With the spikes, the desired acceleration forces can be achieved in a modest range of reciprocal cycling rates. Also, it is important that the secondary as well as the primary apparatus be efficient and absorb very little energy since such absorption tends to defeat their purposes. In the event that the user is not able or is advised against providing either any or all of the energy, any of a wide variety of means could be used to provide the energy and one such means is depicted schematically in FIG. 2. In this figure the apparatus of FIG. 1 is shown in elevation with the components numbered as in FIG. 1. In addition, there is link 34 pivotally attached at one end to platform 10 at 35 and at its other to the lower end 36 of the arm 37. The upper end 38 of arm 37 is pivotally attached to fixed structure 39 which can be ceiling, a wall, a stand, or the like. Arm 37 is caused to swing through an arc, such as A, by link 40 with end 41 pivotally attached to it at 42. The other end 43 of link 40 is attached at any of a series of points 44 on crankarm 45 driven by motor 46 which is also attached to fixed structure, either structure 39 or the equivalent. Motor 46 incorporates reduction gearing and is controllable, variable speed. When the motor is turned on and the crankarm is rotating, link 40 causes arm 37 to swing through an arc as noted and, via link 34, causes the platform 10 to move with reciprocal motion through the tracks. The extent of the motion is adjustable by the selection of points 44 on crank arm 45 to which end 43 of link 40 is attached. The speeds achieved in the reciprocal motion cycle are directly related to motor speed. The envelope of motion extent and speeds encompasses the range from short strokes at low speed to long strokes at high speeds.

In another variation of the subject apparatus, shown semi-schematically in elevation view in FIG. 3, the head end of the apparatus is raised on adjustable supports 47. The effect of this positioning is that a component of the force of gravity on the combined mass of the platform and user increases the tendency of the user and platform to move toward the foot end of the apparatus, thus making the forces required to cause motion by one or both legs to be directly related to the weight of the user. Accordingly it is less necessary to adjust the tensions or rates of the energy storage and release apparatuses in order to make the forces relate to the weights of the various users when the user's legs are actively involved in the exercise. Furthermore, the forces acting in the two directions are differentiated with the inertial forces acting in the head to foot direction exceeding those acting in the foot to head direction. The opposite wall will occur when the foot end of the apparatus is raised.

The secondary energy storage and release apparatus is shown in FIG. 4. It comprises a base 58 which is a modified channel having upstanding sides 59 and 60. Rods 61 and 62 are parallel to each other and bottom 63 of the channel and are free to slide lengthwise in bearings 64, 65, 66 and 67 set in the sides. Ends 68 and 69 of rods 61 and 62 are fastened to plate 70 and ends 71 and 72 are fastened to plate 73. Plates 70 and 73 are parallel to each other and perpendicular to the longitudinal axes of the rods. In each plate there are six keyhole shaped holes, of which holes 74 and 75 are typical. The holes are spaced equidistant from each other and the axes of the rods. There are similarly located and spaced circular holes in the sides 59 and 60. There are six elastic cord assemblies, of which assembly 76 is typical. Each assembly comprises a length of elastic cord with a ferrule attached to each end, ferrule 77 being typical.

Each cord assembly is installed in the apparatus by threading it through a matching pair of holes in the sides and then attaching each end to a plate by inserting the ferrules through the circular parts of the keyholes and lowering the cord into the slot parts of the keyholes. Clamp bar 78 is then attached to base 58 by fasteners 79 and 80. It can be unerstood at this point that the movable assembly, comprising the rods and plates, can be displaced relative to the base in the direction of the axes of the rods and such displacement will be resisted by the elastic cords which tend to return the moving assembly to its initial position. The initial position of the movable assembly relative to the base is adjustable by loosening fasteners 79 and 80, allowing the cords to move with the movable assembly as it is positioned, and then refastening the clamp bar firmly in place. Once the positioning adjustment is complete, adjustment of the energy storage and release capacity is effected by disconnecting one or more of the cord ends so that anywhere from one to six cords may be in use on either end.

The secondary apparatus is fastened between the rails on which the cradle rides, under the cradle and between the ends of the cradle with flanges 81 and 82 attached to the rail. As a result, when the cradle moves it is first under the influence of the primary energy storage and release apparatus. When it has moved to the point of contact between one of the plates of the secondary apparatus and an end of the cradle and beyond, it is under the influence of both the primary and secondary apparatuses, as desired. Appropriate contact cushioning pads and motion limiting pads are provided between the interacting components of the apparatus.

The adjustment of the energy storage and release apparatuses by altering the numbers of elastic cords in use and/or by adjusting the initial tensions set into the cords in use has the fundamental effect of adjusting the energy storage capacities of the apparatuses. Inherent in the adjustment of the storage capacities are adjustments of the force levels and spring rates of the apparatuses. The positioning adjustment of the secondary apparatus effects differential adjustment of the energy storage capacity in the head-to-foot and foot-to-head directions of that apparatus, along with related force and rate changes.

It can be understood from this description of the apparatus that it is primarily designed for cardiovascular stimultaion and toning. The muscular strength needed to operate the unpowered embodiment may be minimal and yet sufficient to cause the stimulating acceleration spikes. With the powered embodiment, the benefits are achieved with no requirement for voluntary muscular exercise.

Using techniques well known in the art, the apparatus is made collapsible by folding and by telescopic joints to make it more compact for transport and storage.

People knowledgeable in the art will understand from this description of the subject invention that it meets the stated objective.

The forces on the user are controllable and in the range from a fraction of the force of gravity to multiples of the force of gravity, particularly in the operational mode in which the acceleration spikes occur. The forces have a dual rate of variation characteristic, adjustable to suit user requirements. The magnitudes of the forces in the foot to head direction are independently controllable relative to the magnitudes of the forces in the head to foot direction. The apparatus provides exercise primarily for the purposes of cardiovascular stimulation and toning. The apparatus is relatively simple to make and use and it is compact in terms of spaces needed for use and storage.

The embodiments of the invention as described are examples of embodiments of the invention and those skilled and knowledgeable in the art will understand that there can be modifications of these embodiments as well as other embodiments of the invention without departing from the spirit of the invention which is limited only by the scope of the appended claims.

What is claimed is:

1. An exercise apparatus comprising:

a track assembly having a first end and a second end, and further comprising:

a first track, a second track, means for interconnecting said first and second tracks whereby said tracks are positioned parallel to each other, a platform for supporting a user in the supine position, said platform having a head end, a foot end and sides, means for attaching said platform to said track assembly whereby said platform is free to move between said first and second ends, primary energy storage and release means for biasing said platform toward a position on said track assembly essentially midway between said first and second ends, secondary energy storage and release means for biasing said platform toward said position, said secondary means attached to said track assembly and positioned to engage said platform whereby the effects of said engagement of said secondary means are supplemental to the effects of said primary means for biasing, means for adjusting the storage capacity of said primary means, foot rest means and hand grippable means attached to said track assembly whereby said user applying hand and/or foot forces can set said platform into oscillating motion on said track assembly.

2. The apparatus of claim 1, further comprising means for adjusting the storage capacity of said secondary means for energy storage and release.

3. An exercise apparatus comprising:

a track assembly having a first end and a second end, and further comprising:

a first track, a second track, means for interconnecting said first and second tracks whereby said tracks are positioned parallel to each other, a platform for supporting a user in the supine position, said platform having a head end, a foot end and sides, means for attaching said platform to said track assembly whereby said platform is free to move between said first and second ends, primary energy storage and release means for biasing said platform toward a position on said track assembly essentially midway between said first and second ends, secondary energy storage and release means for biasing said platform toward said position, said secondary means attached to said track assembly and positioned to engage said platform whereby the effects of said engagement of said secondary means are supplemental to the effects of said primary means for biasing, means for adjusting the storage capacity and said secondary means, foot rest means and hand grippable means attached to said track assembly whereby said user applying hand and/or foot forces can set said platform into oscillating motion on said track assembly.

* * * * *